US007014568B2

(12) United States Patent
Pelz

(10) Patent No.: US 7,014,568 B2
(45) Date of Patent: Mar. 21, 2006

(54) GOLF CLUB

(76) Inventor: David Pelz, 1310 R.R. 620 South, Suite B-1, Austin, TX (US) 78734

( * ) Notice: Subject to any disclaimer, the term of this patent is extended or adjusted under 35 U.S.C. 154(b) by 0 days.

(21) Appl. No.: 10/496,236

(22) PCT Filed: Nov. 18, 2002

(86) PCT No.: PCT/US02/36990

§ 371 (c)(1),
(2), (4) Date: Jun. 10, 2004

(87) PCT Pub. No.: WO03/045507

PCT Pub. Date: Jun. 5, 2003

(65) Prior Publication Data

US 2004/0214654 A1 Oct. 28, 2004

Related U.S. Application Data

(60) Provisional application No. 60/351,623, filed on Jan. 23, 2002, provisional application No. 60/331,513, filed on Nov. 19, 2001.

(51) Int. Cl.
*A63B 53/04* (2006.01)

(52) U.S. Cl. ..... 473/287; 473/290; 473/331

(58) Field of Classification Search ..... 473/289, 473/290, 331, 330, 324, 350, 342, 313, 314, 473/316, 287
See application file for complete search history.

(56) References Cited

U.S. PATENT DOCUMENTS

| | | | |
|---|---|---|---|
| 4,754,970 | A | 7/1988 | Kobayashi |
| 4,792,140 | A | 12/1988 | Yamaguchi et al. |
| 5,437,088 | A | 8/1995 | Igarashi |
| 5,688,186 | A | 11/1997 | Michaels et al. |
| 5,766,087 | A | 6/1998 | Kawamatsu |
| 5,924,936 | A | 7/1999 | Penley |

*Primary Examiner*—Sebastiano Passaniti
(74) *Attorney, Agent, or Firm*—Darby & Darby

(57) ABSTRACT

A set of golf club wedges each having a club face (10) is disclosed wherein the lofts of the individual clubs progressively increases. The hitting surface of each club head may take the form of an insert (12) that includes a series of grooves, the design of which is varied from club to club to provide increasing friction with loft. As a result, a golfer can impart the same amount of spin to a golf ball with each of the wedges despite a substantial difference in loft and club head swing speed between the respective clubs. In addition, the surface roughness of the hitting surface may also be increased as loft increases to further control the spin imparted to the ball.

18 Claims, 2 Drawing Sheets

PGI DISTANCE CONTROL WEDGE SYSTEM

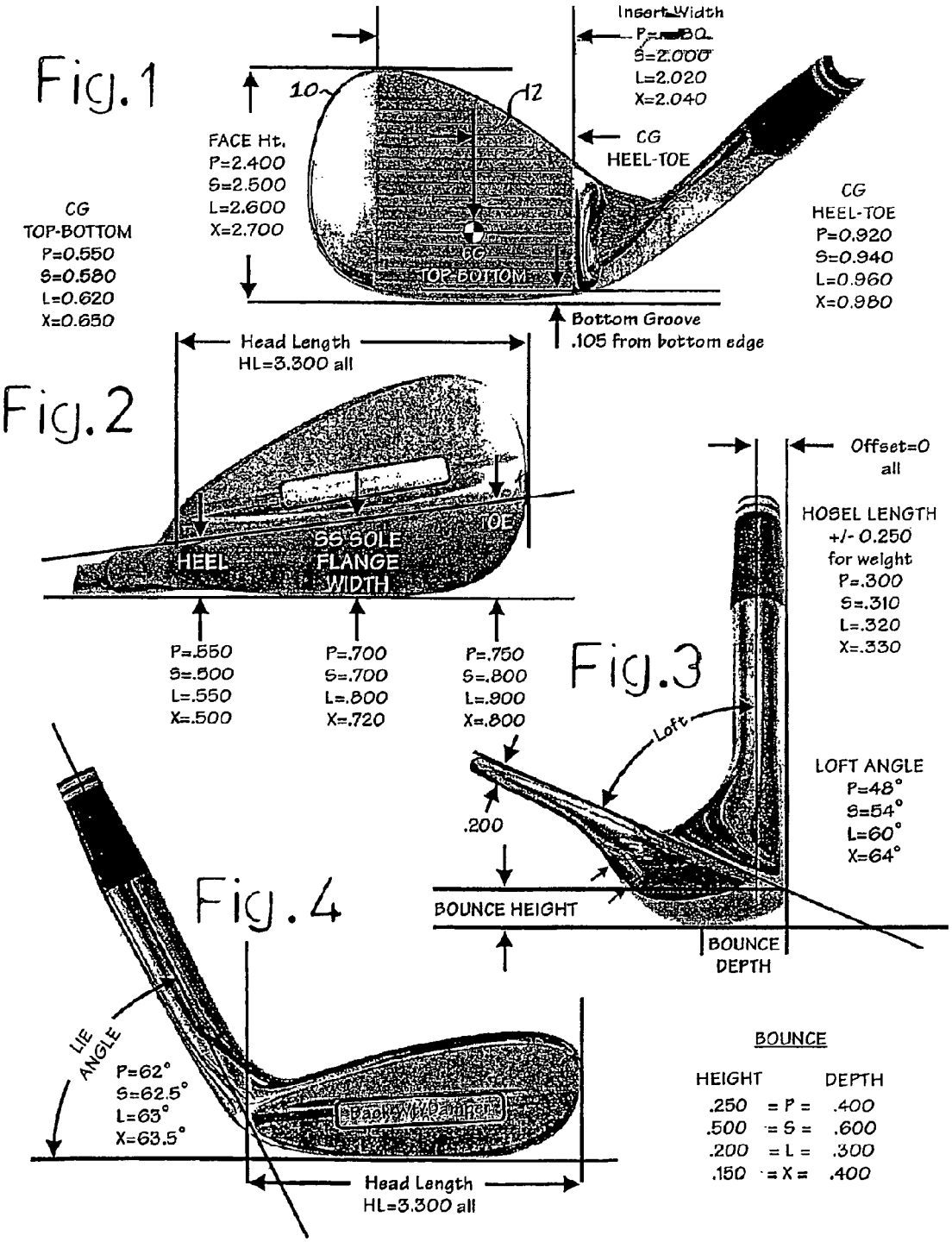
Fig. 1
Insert Width
P=[illegible]
S=2.000
L=2.020
X=2.040
10
12
FACE Ht.
P=2.400
S=2.500
L=2.600
X=2.700
CG
HEEL-TOE
CG
TOP-BOTTOM
P=0.550
S=0.580
L=0.620
X=0.650
CG
HEEL-TOE
P=0.920
S=0.940
L=0.960
X=0.980
CG
TOP-BOTTOM
Bottom Groove
.105 from bottom edge
Head Length
HL=3.300 all
Fig. 2
HEEL
SS SOLE
FLANGE
WIDTH
TOE
P=.550
S=.500
L=.550
X=.500
P=.700
S=.700
L=.800
X=.720
P=.750
S=.800
L=.900
X=.800
Fig. 3
Offset=0
all
HOSEL LENGTH
+/- 0.250
for weight
P=.300
S=.310
L=.320
X=.330
Loft
LOFT ANGLE
P=48°
S=54°
L=60°
X=64°
.200
BOUNCE HEIGHT
BOUNCE
DEPTH
Fig. 4
LIE
ANGLE
P=62°
S=62.5°
L=63°
X=63.5°
Head Length
HL=3.300 all
BOUNCE
HEIGHT DEPTH
.250 = P = .400
.500 = S = .600
.200 = L = .300
.150 = X = .400

PGI DISTANCE CONTROL WEDGE SYSTEM

GOLF CLUB

This application claims priority under 35 U.S.C. § 371 based on International Application No. PCT/US02/36990, filed Nov. 18, 2002; published as WO 03/045507 on Jun. 5, 2003; which claims priority to U.S. Provisional Application Ser. No. 60/331,513, filed Nov. 19, 2001 and U.S. Provisional Application Ser. No. 60/351,623, filed Jan. 23, 2002.

This invention relates to golf clubs and, more particularly, to a set of wedges having related physical characteristics enabling a golfer to more accurately control relatively short golf shots to a green.

BACKGROUND OF THE INVENTION

As golf clubs have evolved over the years, modern golfers often carry three and sometimes four wedges to enhance the accuracy of golf shots to a green from about 120 yards or less. The distance a club is designed for is dependent primarily on the loft angle of the club face. For example, a pitching wedge may have a loft of about 50 degrees and sand wedges a loft of about 56 degrees. Relatively recently, lofted wedges have become popular with lofts typically varying between 58 and 64 degrees. Obviously, the distance for which a particular club is used varies significantly from golfer to golfer but for low handicap golfers there is usually a significant difference in shot distance achieved when using a pitching wedge and a lofted wedge.

In addition to club loft, the flight of a golf ball is affected also by the surface of the club which strikes the ball. It is known that the spin control of a ball is affected by the depth and placement of grooves in the face of the club as well as the friction characteristics of the club face surface. Higher friction club face surfaces will impart more spin to a ball as will larger width grooves, sharper edged grooves, deeper grooves and more closely spaced grooves. The ability to impart backspin to a golf ball tends to prevent the ball from moving in a forward direction after it lands on the green and therefore is usually beneficial, but excessive backspin can be detrimental in some cases. For elite golfers, the ability to impart the same backspin to a ball for any of a number of highly lofted clubs would be advantageous.

The principal object of this invention is to provide a series of wedges which vary considerably in loft wherein the spin rate imparted to a golf ball is approximately the same for each wedge, for a comparable swing.

SUMMARY OF THE INVENTION

In accordance with the invention, a series of wedges (for example, four) having different lofts is provided. The defining parameters of the grooves of the individual clubs are progressively varied depending on loft, to provide increased friction with increased loft. By varying the grooves in the faces as a function of club loft, a series of wedges is provided in which the same spin rate can be achieved with each of the clubs in the series.

The wedges may utilize a club face of a constant surface roughness so that, regardless of club loft, the surface friction is held constant and only the grooves of each club are varied to provide the changing impact friction required to provide constant spin rate. Alternatively, the frictional characteristics of the striking face surfaces of the clubs may also be controlled to provide progressively increasing surface friction from the lower lofted clubs to the higher lofted clubs.

In accordance with a further feature of the invention, the hitting surface of the club is formed by an insert made of a material which will not loose its frictional characteristics or groove shapes as rapidly as industry common wedges with use. This is a problem with clubs having surfaces roughened by abrasive blasting. The insert enables the constant spin rate characteristic described above to be retained even after practicing sand shots over long periods of time.

THE DRAWINGS

FIG. 1 is a front elevational view showing the face of a wedge in accordance with a preferred embodiment of the invention;

FIG. 2 is a bottom plan view of the wedge;

FIG. 3 is a side elevational view of the wedge;

FIG. 4 is a rear elevational view of the wedge; and

Figure 5:
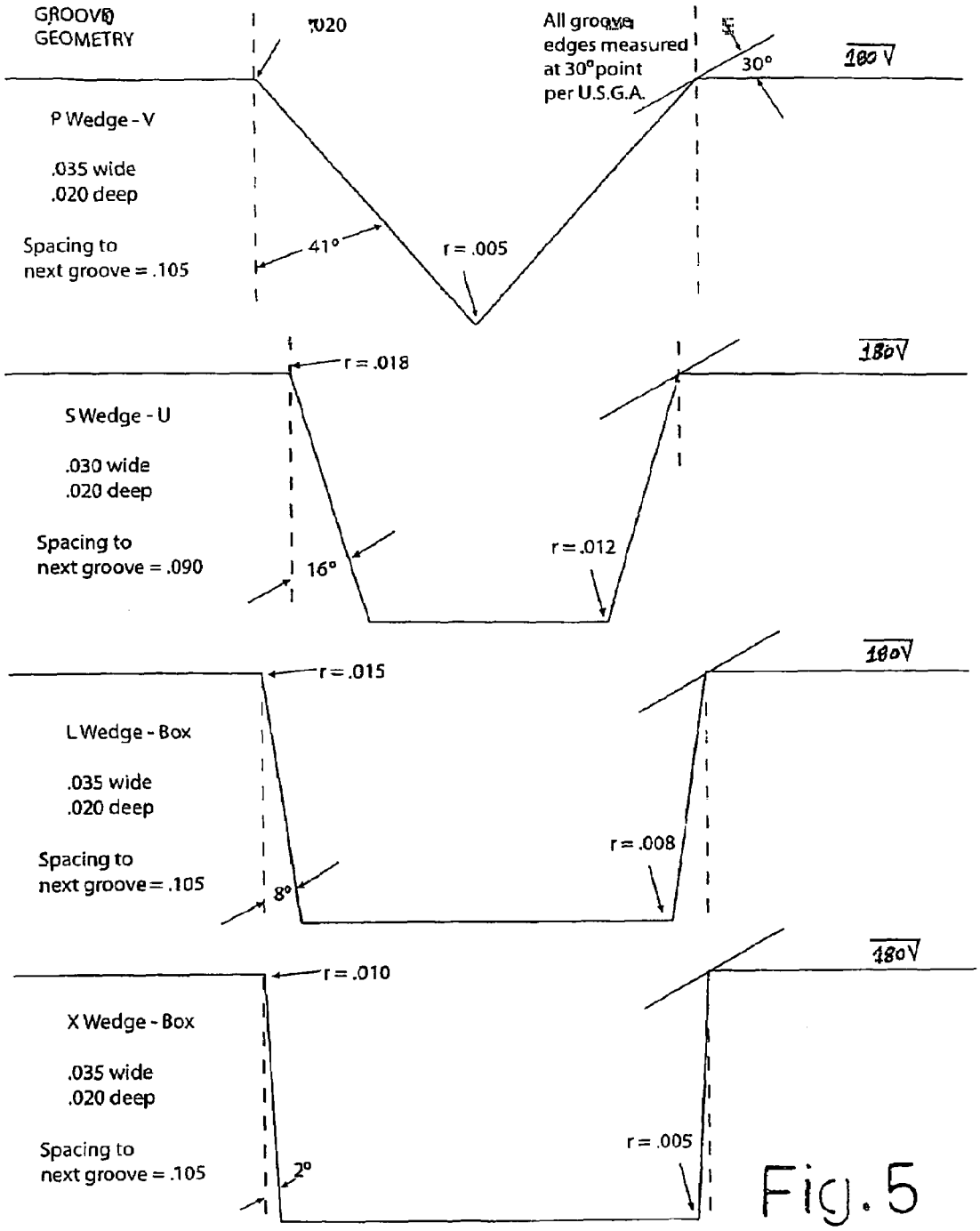

FIG. 5 comprises a series of schematic illustrations showing the groove configuration for a series of four wedges in accordance with the preferred embodiment of the invention.

DETAILED DESCRIPTION

As the loft of a wedge increases, the potential of the club to impart spin to the ball also increases. Spin also depends on how hard the ball is hit; all other things being equal, the harder the hit with a given wedge, the greater the spin. In accordance with a preferred embodiment of the invention, the length of the shaft decreases and the weight of the head increases as the loft of the wedge increases. This means that a ball will not be struck as hard with a higher lofted club (because its shaft is shorter and head weight is greater, leading to slower swing speeds from a constant effort by the golfer), with the result that the spin imparted to the ball is less. The invention takes into consideration the loft of the club and the hitting force for the club to provide progressive changes in the club faces which will tend to produce constant spin-induced reactions on a golf green, for each of a series of wedges.

To compensate for the reduced spin imparted by the higher lofted clubs, in accordance with the invention the groove configuration is changed to increase friction between the club face and the ball, to maintain spin results as loft increases.

It is known that the characteristics of the grooves in the face of the club affect the spin imparted to a golf ball. Generally speaking, the greater the volume of the grooves, the greater the spin, especially out of wet or grassy lie conditions. USGA regulations prescribe in detail permissible sizes and shapes of grooves as well as the spacing between grooves. In accordance with the invention, in order to impart the same spin to a golf ball for each of the various wedges in a set, certain of the defining parameters of the grooves are progressively changed from wedge to wedge so that as loft increases and swing speeds decrease, greater spin per unit of club head speed is provided. The result of these changes (surface frictional characteristics and/or groove parameters) is that a skilled golfer can impart approximately the same spin to a ball with any one of four wedges ranging from a 48° pitching wedge to a 64° extra lofted wedge.

FIGS. 1–4 show an exemplary wedge in accordance with a preferred embodiment of the invention. The various parameters which define the club are indicated in the drawings and in Table I below which lists the specific design parameters for a set of four wedges in accordance with a preferred embodiment of the invention. The wedges are characterized as a pitching wedge (P), sand wedge (S), lofted wedge (L), and an extra lofted wedge (X). Obviously, the invention is not limited to specific design parameters and Table I is intended to be exemplary only.

The defining parameters of a groove are shape, width, depth, spacing and edge sharpness. See FIG. 5. The shape of the grooves is characterized as "V", "U", and "box". A U-shaped groove has a slight curve at the bottom and a box-shaped groove is flat or approximately flat along its bottom surface. The "30° rule" as illustrated in FIG. 5 defines the edges of a groove as the point of contact between each upper edge of the groove and a line drawn at 30° to the horizontal. Width is measured from edge to edge. In the preferred embodiment, shape and edge sharpness are different in each case. As indicated in Table I, the top edge radius decreases as the loft of the wedge increases. This means that the higher lofted clubs have progressively sharper edges on the grooves which affects friction and spin control. The change in groove geometry (as loft increases) enables a skilled golfer to impart the same spin to a ball with each of the wedges despite the differences in loft, shaft length and club length.

In the preferred embodiment, the sole bounce dimensions (height and depth) and flange width provide graduated contouring designed to provide optimum turf glide for each wedge.

In the preferred embodiment of the invention, the club face 10 (FIG. 1) includes an insert 12 which is bonded to the face of the club. The width and height of exemplary inserts are indicated in FIG. 1. The height of an insert corresponds essentially to the entire face of the club between the two lines representing the insert width. The insert is secured in a suitable recess within the club face in any suitable fashion, for example, by an adhesive or by welding.

In the set of wedges defined in Table I, the roughness of the club face surface is progressively increased as loft increases. In Table I, "surface roughness" refers to the difference between the average depth of the surface and the highest peak of the surface. The higher the index, the greater the friction. "GC" means center of gravity. The combination of surface roughness and groove configuration enables close control of the spin imparted to a ball, but it is not necessary that the surface roughness vary from wedge to wedge. Excellent results have been obtained where only the groove geometry of the club face insert is varied to provide the constant spin rate. In this embodiment of the invention, the surface roughness was maintained at approximately 180 micro-inches for each of the club heads. The groove geometry conformed to Table I.

The preferred material for the club face insert is a high-strength 440C stainless steel. This type of steel is manufactured and sold by Carpenter Technology Corporation under the trademark 440-XH™. Its chemical composition is approximately 1.60% carbon, 0.50% manganese, 0.40% silicon, 16.00% chromium, 0.35% nickel, 0.80% molybdenum, 0.45% vanadium and the remaining amount iron. The steel composition is micro-machined to the desired surface roughness (e.g. 180 microinches) and then tempered to the desired hardness, not to exceed 64 HRC (Rockwell Nominee Hardness). The insert may also be made of a high friction powdered material comprising diamond, tungsten, carbide and bronze which was sintered to form an insert about 0.1 inches thick.

TABLE I

| Distance Control Wedge Categories | | Pitching P | Sand S | Lofted L | Extra-lofted X |
|---|---|---|---|---|---|
| | | Heads | | | |
| Material-forged | | CRS | CRS | CRS | CRS |
| Material-cast | | SS-304 | SS-304 | SS-304 | SS-304 |
| | Hardness, heat-treatment | Soft | Soft | Soft | Soft |
| | Finish-forged | Chrome plate | Chrome plate | Chrome plate | Chrome plate |
| | Finish-cast | Polished | Polished | Polished | Polished |
| Bounce | Bounce-height (inches) | 0.250 | 0.500 | 0.200 | 0.150 |
| | Bounce-depth (inches) | 0.400 | 0.600 | 0.300 | 0.400 |
| Sole flange width | (inches at toe) | 0.750 | 0.800 | 0.900 | 0.800 |
| | (inches at sweet spot) | 0.700 | 0.700 | 0.800 | 0.720 |
| | (inches at heel) | 0.550 | 0.500 | 0.550 | 0.500 |
| Head weight | (grams) | 325 | 333 | 341 | 349 |
| Hosel length adjustable +/− .250 to attain weight (inches) | | 3.00 | 3.10 | 3.20 | 3.30 |
| Weight distribution | cg: top-bottom (inches) | 0.550 | 0.580 | 0.620 | 0.650 |
| | cg: heel-toe (inches) | 0.920 | 0.940 | 0.960 | 0.980 |
| | | Grooves: | | | |
| | top shape (overall) | V | U | box | box |
| | side angle (degrees from vertical) | 41 | 16 | 8 | 2 |
| | top width (inches, 30 degree rule) | 0.035 | 0.030 | 0.035 | 0.035 |
| | top edge radius (inches) | 0.020 | 0.018 | 0.015 | 0.010 |
| | spacing between edges (inches) | 0.105 | 0.090 | 0.100 | 0.105 |
| | bottom shape | V | U | box | box |
| | bottom radius (inches) | r = .005 | r = .012 | r = .008 | square |

TABLE I-continued

| Distance Control Wedge Categories | | Pitching P | Sand S | Lofted L | Extra-lofted X |
|---|---|---|---|---|---|
| | depth (inches) | 0.020 | 0.020 | 0.020 | 0.020 |
| | Surface roughness (micro inches) | 150 | 160 | 170 | 180 |
| Loft (degrees) | 49 | 55 | 60 | 64 | |
| Lie (degrees) | 63 | 63.5 | 64 | 64.5 | |

Most manufacturers tend to provide a constant shaft length for all wedges in a given set. In accordance with a preferred embodiment of the invention, however, shaft length is decreased with increasing loft which means that the distance provided by the club is diminished for this reason as well. When a shaft is reduced in length, the natural (resonant) frequency of vibration increases, which causes the shaft to feel stiffer. In the preferred embodiment of the invention, as the shaft length is decreased with increasing loft, the frequency of the shaft (and thus its stiffness) is also decreased so that the "feel" of the various wedges remains unchanged.

Table II lists the defining parameters of exemplary shafts and grips which may be used with a set of wedges in accordance with the invention.

TABLE II

| | | | | | |
|---|---|---|---|---|---|
| | | Shafts | | | |
| Material: | light weight steel | | | | |
| Length: | mens (inches) | 35.5 | 35 | 34.5 | 34 |
| | ladies (inches) | 34.5 | 34 | 33.5 | 33 |
| Flex code letter (frequency) | | R (5.5) | R (5.0) | R (4.5) | L (4.0) |
| Off-set (inches) | | 0 | 0 | 0 | 0 |
| | | Grips | | | |
| Material, color | | Rubber-black | Rubber-black | Rubber-black | Rubber-black |
| Shape-length (inches) | | round-11.5 | round-11.5 | round-11.5 | round-11.5 |
| Size: men | top (diameter-inches) | 1.10 | 1.10 | 1.10 | 1.10 |
| | bottom (diameter-inches) | 0.95 | 0.95 | 0.95 | 0.95 |
| ladies | top (diameter-inches) | 1.00 | 1.00 | 1.00 | 1.00 |
| | bottom (diameter-inches) | 0.85 | 0.85 | 0.85 | 0.85 |

I claim:

1. A set of at least three golf wedges having club heads of progressively increasing lofts, each of the club heads having a surface for striking a golf ball, with each surface including a series of grooves, the surfaces having frictional characteristics which increase with club loft, wherein the frictional characteristics are controlled by varying at least one of groove shape, groove spacing, groove edge sharpness, and surface roughness, the change in frictional characteristics being selected so that the back spin imparted to a golf ball when struck with equal force by each one of the wedges is substantially the same.

2. A set of wedges according to claim 1, wherein each of said wedges includes a shaft with the length and stiffness of the shafts decreasing with increasing loft.

3. A set of wedges according to claim 1, wherein the shape of the grooves varies from wedge to wedge, with the sides of the grooves becoming progressively steeper with increasing loft.

4. A set of wedges according to claim 3, wherein the radii of the top edges of the grooves vary from wedge to wedge, with the radii of the top edges decreasing with increasing loft.

5. A set of wedges according to claim 3, wherein the surface roughness of said surfaces increases from wedge to wedge with increasing loft.

6. A set of wedges according to claim 1, wherein the radii of the top edges of the grooves vary from wedge to wedge, with the radii of the top edges decreasing with increasing loft.

7. A set of wedges according to claim 6, wherein the surface roughness of said surfaces increases from wedge to wedge with increasing loft.

8. A set of wedges according to claim 1, wherein the surface roughness of said surfaces increases from wedge to wedge with increasing loft.

9. A set of wedges according to claim 1, wherein each of the said surfaces is provided in the form of an insert which is secured to the club head.

10. A set of wedges according to claim 1, wherein each of said wedges includes a shaft with the length of the shafts decreasing with increasing loft.

11. A set of at least three golf wedges having club heads of progressively increasing lofts, each of the club heads having a surface for striking a golf ball, with each surface including a series of grooves, the surfaces having frictional characteristics which increase with club loft, wherein the frictional characteristics are controlled by varying at least one of groove shape, groove spacing, and groove edge sharpness, the change in frictional characteristics being selected so that the back spin imparted to a golf ball when struck with equal force by each one of the wedges is substantially the same.

12. A set of wedges according to claim 11, wherein the shape of the grooves varies from wedge to wedge, with the sides of the grooves becoming progressively steeper with increasing loft.

13. A set of wedges according to claim 12, wherein the surface roughness of said surfaces increases from wedge to wedge with increasing loft.

14. A set of wedges according to claim 11, wherein the radii of the top edges of the grooves vary from wedge to wedge, with the radii of the top edges decreasing with increasing loft.

15. A set of wedges according to claim 14, wherein the surface roughness of said surfaces increases from wedge to wedge with increasing loft.

16. A set of wedges according to claim 11–14, wherein the surface roughness of said surfaces increases from wedge to wedge with increasing loft.

17. A set of wedges according to claim 11, wherein each of said wedges includes a shaft with the length and stiffness of the shafts decreasing with increasing loft.

18. A set of wedges according to claim 17, wherein the radii of the top edges of the grooves vary from wedge to wedge, with the radii of the top edges decreasing with increasing loft.

* * * * *